US006454818B1

(12) United States Patent
Lin et al.

(10) Patent No.: US 6,454,818 B1
(45) Date of Patent: Sep. 24, 2002

(54) POLY(OXYALKYLENE) AMIDE-AMINE GASOLINE ADDITIVES

(75) Inventors: Jiang-Jen Lin, Taichung; Wei-Shiun Ku, Chiai; Che-Nan Lee, Chiai; Yung-Sheng Ho, Chiai; Kun-Hai Lin, Chiai; Kuo-Min Wei, Chiai, all of (TW)

(73) Assignee: Chinese Petroleum Corp., Taipei (TW)

( * ) Notice: Subject to any disclaimer, the term of this patent is extended or adjusted under 35 U.S.C. 154(b) by 0 days.

(21) Appl. No.: 09/649,031

(22) Filed: Aug. 28, 2000

(51) Int. Cl.[7] ..... C10L 1/18; C10L 1/22

(52) U.S. Cl. ..... 44/418; 44/419; 564/133; 564/135; 564/197

(58) Field of Search ..... 44/418, 419; 564/133, 564/135, 197

(56) References Cited

U.S. PATENT DOCUMENTS 3,150,941 A * 9/1964 Kautsky et al. ..... 44/381
5,837,016 A * 11/1998 Ishida et al. ..... 44/333
5,855,630 A * 1/1999 Lin et al. ..... 44/419

* cited by examiner

*Primary Examiner*—Cephia D. Toomer
(74) *Attorney, Agent, or Firm*—Michael D. Bednarek; Shaw Pittman LLP

(57) ABSTRACT

The present invention is one kind of gasoline additives. The compounds consist of tertiary amine, amide and poly (oxybutylene) backbone in the same molecule. The process of making this type of products required an initiator containing primary amine and tertiary amine as the starting diamines. The primary amine will be converted into amide, while the tertiary amine remained intact. Then the amide is converted into butoxylates through butoxylation at CON—H position. The preparation therefore involved two steps: (1) amidation of diamines containing primary/tertiary amines with ethyl acetate to form amidoamines, and (2) butoxylation of this amidoamines to poly(oxybutylene) amidoamine. The product is gasoline soluble and can be used as additive having good performance of detergency and octane requirement reduction.

5 Claims, No Drawings

POLY(OXYALKYLENE) AMIDE-AMINE GASOLINE ADDITIVES

BACKGROUND OF THE INVENTION

1. Field of the Invention

The present invention is one kind of gasoline additives. The present invention can be used as additive having good performance of detergency and octane requirement reduction.

2. Background

The composition of gasoline includes hundreds of saturated, unsaturated, cyclic and aromatic hydrocarbons. In theory, there is no carbonaceous deposit on intake valves after pure hydrocarbons complete combusted. The gasoline comprises a minor amount of high molecular weight impurities such as polynuclear aromatics and unsaturates such as diesters and the processes of incomplete oxidation produce the format ion of gums and the adherence of gums will combine more impurities and then accumulate in the gasoline inlet. The carbonaceous will change the ratio between air and gasoline in the engine, and reduce the gasoline performance and induce exhaust emission.

Recently, because the environmental protection improves, using gasoline additives to clean the surface of the gasoline inlet can keep the engine in climax. Otherwise the carbonaceous will reduce the fuel economy of gasoline and increase exhaust emission.

The present invention is one kind of gasoline additives, and it can reduce deposit formation on the intake valves, octane requirement and consequently improve gasoline performance and quality.

SUMMARY OF THE INVENTION

The present invention is one kind of gasoline additives. The compounds consist of tertiary amine, amide and poly (oxybutylene) backbone in the same molecule. The novelty of the compounds is the existence of these functionalities in the same structure that is unprecedented in prior arts.

The structure of these poly(oxyalkylene)amide-amine containing tertiary amine, amide and poly(oxyalkylene) backbone are of the following formula:

Structure 1

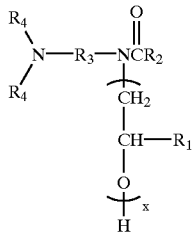

wherein, $R_1$ is alkyl of 1 to 12 carbon atoms; $R_2$ is methyl, ethyl or propyl; $R_3$ is the group consisting of alkylene of 1 to 6 carbon atoms; $R_4$ is alkyl of 1 to 4 carbon atoms, and x is from 5 to 30.

Synthesizing the poly(oxyalkylene)amide-amine gasoline additives includes two steps: (1) amidation of diamines containing primary/tertiary amines with ethyl acetate to form amidoamines, and (2) butoxylation of this amidoamines to poly(oxybutylene)amidoamine.

Generally the process of making the compound comprises the following reaction:

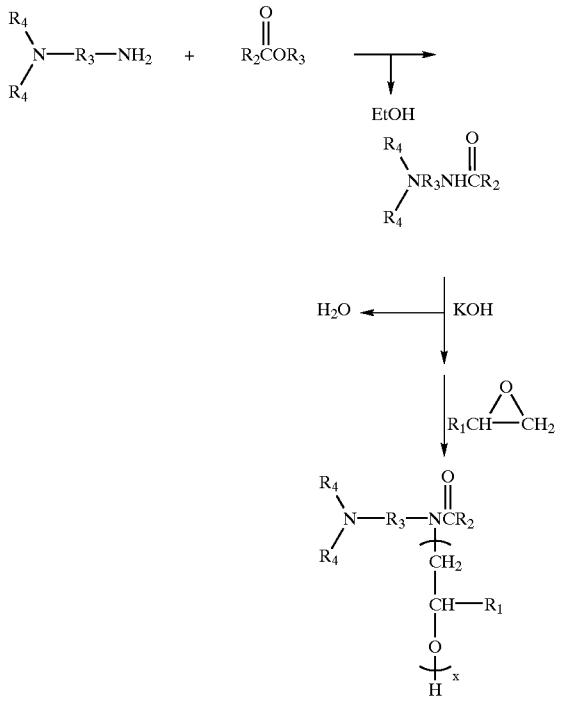

Wherein $R_1$ is alkyl of 1 to 12 carbon atoms; $R_2$ is methyl, ethyl and propyl; $R_3$ is the group consisting of alkylene of 1 to 6 carbon atoms; $R_4$ is alkyl of 1 to 4 carbon atoms; $R_5$ is alkyl of 1 to 4 carbon atoms, and x is from 5 to 30.

The poly(oxyalkylene)amide-amine gasoline additives can reduce the accumulation of deposits on the intake valves, octane requirement and consequently improve gasoline performance and quality.

Accordingly, another embodiment of the present invention is a gasoline composition comprising a mixture of:

(a) a major amount of hydrocarbons in the boiling range;

(b) a minor amount of an additive compound having the general formula as described above (structure 1); and (c) a minor amount of an additive detergent selected from the group consisting of polyalkenyl amines, Mannich amines, alkyl succinimides, poly(oxyalkylene carbamate and mixtures thereof.

DETAILED DESCRIPTION OF THE INVENTION

The present invention is one kind of gasoline additives. The compounds consist of tertiary amine, amide and poly (oxybutylene) backbone in the same molecule. The novelty of the compounds is the existence of these functionalities in the same structure that is unprecedented in prior arts. The process of making this type of products required an initiator containing primary amine and tertiary amine as the starting diamines. The primary amine will be converted into amide, while the tertiary amine remained intact. Then the amide is converted into butoxylates through butoxylation at CON—H position.

Synthesizing the poly(oxyalkylene)amide-amine gasoline additives includes two steps. The first step is amidation of diamines containing primary/tertiary amines with ethyl acetate to form amidoamines. A mixture of 3-(Diethylamino)propylamine (DAP) (59 g, 0.26 moles) and ethyl acetate (EtOAc) (91 g, 1.03 moles) was into a one liter autoclave. Then the autoclave was sealed and purged of air by pressurizing and depressurizing with nitrogen at 50 psi several times. With stirring and an initial nitrogen pressure of 500 psi, the mixture was heated slowed to 180° C. and then held at this temperature for over 15 hours. Then the pressure decreased with time, this was because ethyl acetate became liquid phase form vapor phase. The time of the pressure stopped decreases about 8 hours. The mixture was then cooled to ambient temperature, and excess gas was vented and the product was recovered as a light brown liquid. The crude product was rotovapped at 90° C. to remove ethyl acetate. The weight of the crude product was 74 g, and the recovery ratio was 93%.

The crude product was analyzed by infrared spectroscopy (IR), and 1650 $cm^{-1}$ is the C═O absorption of amide; 1560 $cm^{-1}$ is the NH absorption of amide.

The second step is butoxylation of this amidoamines to poly(oxybutylene)amidoamine. A mixture of amidoamine (19.46 g, 0.06 moles), potassium hydroxide (0.29 g) was into a one liter autoclave, remove water under vacuum and then 1,2-epoxybutane (81 g, 1.19 moles) was added into autoclave. The autoclave was sealed and purged of air by pressurizing and depressurizing with nitrogen at 50 psi several times. With stirring and an initial nitrogen pressure was 500 psi, the mixture was heated slowed to 140° C. and held at this temperature for over 17 hours. Then the pressure decreased with time, this was because 1,2-epoxybutane became liquid phase form vapor phase. The time of the pressure stopped decreases about 9 hours. The mixture was then cooled to ambient temperature, and excess gas was vented and the product was recovered as a light brown liquid. The crude product was rotovapped at 90° C. to remove 1,2-epoxybutane. The weight of the crude product was 95 g, and the recovery ratio was 96%. The product is gasoline soluble. The reaction process is disclosed below:

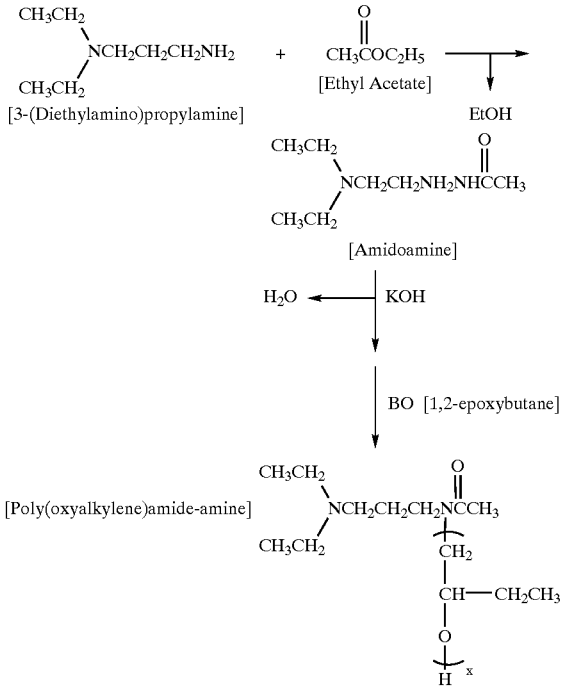

The reaction is carried out in the presence of potassium hydroxide which act as catalysts and the concentration of potassium hydroxide was about 0.2% of the total weight of the mixture.

The crude product was analyzed by gel permeation chromatography (GPC), nuclear magnetic resonance (NMR) and IR. Before using distilled water to extract $K^+$ out of product sample, we estimated molecular weight was 1600. GPC analysis indicated an average molecular weight of Mw=1521 and a poly-dispersity of 1.10. IR analysis indicated 1735 $cm^{-1}$ is the absorption of ester; 1650 $cm^{-1}$ is the C═O absorption of amide and 1100 $cm^{-1}$ is the absorption of ether.

Using the same methods, we can make different molecular weight of compounds (DAP-amidoamine-BO) from 600 to 4000. The other samples are illustrated in the following, tables, in which different molecular weight of compounds of 1200, 1600 and 2200 are shown as follows. (Table 1 and 2)

TABLE 1

Synthesis of amidoamine initators

| | Substrates | Target Mw | Initial $N_2$ pressure (psi) | Reaction Temp. (° C.) |
|---|---|---|---|---|
| Example 1 | DAP + EtOAc | 172 | 500 | 180 |
| Example 2 | DAP + EtOAc | 172 | 500 | 180 |
| Example 3 | DAP + EtOAc | 172 | 500 | 180 |

TABLE 2

Butoxylation of amidoamine

| | Substrates | Target Mw | Initial $N_2$ pressure (psi) | Reaction Temp. (° C.) |
|---|---|---|---|---|
| Example 1 | amidoamine + BO | 1600 | 500 | 140 |
| Example 2 | amidoamine + BO | 2200 | 500 | 140 |
| Example 3 | amidoamine + BO | 1200 | 500 | 140 |

(Catalyst: 0.2 wt. % KOH of following reaction)

Test Results

In each of the following test, the base fuel was an unleaded gasoline that contained no additives. The poly (oxyalkylene)amide-amine compounds utilized were prepared as indicated by Example 1 and were used at the concentration indicated in ppm by mg/l. The range of the concentration is from 50 ppm to about 500 ppm by weight based on the total weight of the fuel composition. The tests employed are described below and the results of the various tests are set forth in the tables below. The following tests may also contain one or more additional detergents. When additional detergents are utilized, the fuel compositions will comprise a mixture of a major amount of hydrocarbons in the boiling range as described below, a minor of one or more compounds of the present invention and a minor amount of an additional detergent selected from polyalkenyl amine, mannich amines, polyalkylenyl succinimides, poly(ankenyl) N-substituted carbamates, poly(oxyalkylene)carbamates and mixtures thereof. As used herein the term "minor amount" means less than about 10% by weight of the total fuel composition, preferably less than about 1% by weight of the total fuel composition and more preferably less than about 0.1% by weight of the total fuel composition.

The benefits that may be derived by use of carrier fluid, and some tests contain polyether type carrier fluid in 200 mg/l were also evaluated.

Intake Valve Coking Simulator (IVCS)

The IVCS test is a measure of the deposit formation on the hot ramp, and the results denote the tendency of the additive package dispersed the carbonaceous deposit generated on the film. The deposit simulator results were shown to correlate with BMW intake-valve deposit tests. The test fuel is pumped to an injector consisting of a water-cooled hypodermic needle. The ramp is heated at the elevated end with six electric heaters and thermally insulated to achieve a temperature difference of 400° C. at the elevated end and 120° C. at the bottom of the ramp. In the IVCS test equipment, four parallel test cells involved, so four different samples can be conducted at the same time. The base fuel properties and test conditions are shown as follows. (Table 3 and 4)

TABLE 3

The base fuel properties

| Property | Value |
|---|---|
| IBP | 40.3° C. |
| 50% BP | 108.1° C. |
| 90% BP | 163.5° C. |
| Aromatics. | 41.6 vol. % |
| Olefins | 2.8 vol. % |
| Saturates | 48.1 vol. % |
| MTBE | 7.5 vol. % |
| RON | 92 |

TABLE 4

The test conditions

| | |
|---|---|
| Test fuel volume | 250 ml |
| Test fuel flow | 0.83 ml/min. |
| Ramp slop | 5° |
| Stainless steel film | 47 mm W × 1010 mm L × 0.02 mm T |

Before tests, stainless steel test films were thoroughly cleaned with solvent (50% n-hexane and 50% acetone), then put the films into oven at temperature of 120° C. for 1 hour to remove solvent and water. New test films were weighted and installed, and the tests were run for a period of about 5 hours. At the end of each test, the films were removed, cleaned, and weighted again. Weight gain of the deposit on the film is the IVCS index, reported in mg/250 ml. Generally, the less the deposit formation, the better the intake valve detergency performance of the gasoline or additive tested. The results of IVCS are shown as follows. (Table 5)

TABLE 5

The results of IVCS test

| Example No. | Compound conc. (mg/l) | Additional Detergent conc. (mg/l) | Additional Carrier fluid conc. (mg/l) | Deposit (mg/250 ml) |
|---|---|---|---|---|
| — | 0 | 0 | — | 12.1 ± 0.3[1] |
| 1 | 200 | 0 | — | 9.2 |
| 1 | 200 | — | 200 | 3.2 |
| 1 | 100 | 100[2] | — | 2.4 |

[1]0.3 denotes 95% level of confidence interval (24 data points)
[2]GKA67 - polyalkenyl amine available commercially from BASF.

From the IVCS test results, either using the poly (oxyalkylene)amide-amine gasoline additive or cooperating with other additional carrier fluid or additional detergent, the less deposit forms on the film than the base fuel. Thus, the poly(oxyalkylene)amide-amine gasoline additives show good performance in intake valve detergency.

Octane Requirements Reduction Testing

The purpose of octane requirement reduction test is to provide a method of determining the effect of various gasoline components and additives upon the octane requirement of the engine.

The experiment rig mainly consisted of a single-cylinder Waukesha Cooperative Fuel Research (CFR) gasoline engine, pressure transducer, charge amplifier, and a Fast Fourier Transform (FFT) signal analyzer. The critical CFR engine parameters and engine operating conditions are shown as follows. (Table 6)

TABLE 6

The CFR engine parameters and operating conditions

| | |
|---|---|
| Engine | Waukesha, CFR engine<br>612 cc, single cylinder, carburetor |
| Test condition | Air inlet temperature: 38° C.<br>Compression ratio: 7.0<br>Air/Fuel ratio: 13.5<br>Spark timing: 23 BTDC<br>Cooling temperature: 100° C. |

Before octane requirement reduction (ORR) test started, the CFR engine has been dirty up after running engine test of accumulating over 200 hours. Then the initial octane requirement (ONR) of fuel for the CFR engine is determined by detecting knock. The primary reference fuels (PRF) of a variety of RON blended by isooctane and normal heptane are used for ONR rating fuels. If the light engine knock occurred, the FFT signal analyzer displayed a signal which amplitude is higher than 53 dBVr in spectrum correlated by ear rating. The knock signal of the CFR engine comes out around the frequency of 5.8–6.4 kHz. The criterion of determining the ONR value for the engine was determined on the 25 percentage of light knock occurring frequency of 100 continuing power cycles obtained using an intrapolation method.

The engine ORR test starts to run with using base fuel blended with additive. The base fuel properties are shown as follows. (Table 7)

TABLE 7

The base fuel properties

| Property | Value |
|---|---|
| IBP | 40.0° C. |
| 50% BP | 108.6° C. |
| 90% BP | 170.5° C. |
| Aromatics. | 26.8 vol. % |
| Olefins | 25.1 vol. % |
| Saturates | 48.1 vol. % |
| RON | 95 |

The total ORR was calculated as the difference between the ONR numbers of the engine at the beginning and end of the engine test. At the beginning of ORR test, the initial ONR of the CFR engine is 90.7 RON. After the ORR test for additive was completed, the ONR condition being 89.9 RON. The test results for additives are shown as follows. (Table 8)

TABLE 8

The results of ORR test

| Test fuel: Base fuel + 200 mg/l Example 1 | New engine | Dirty-up engine |
|---|---|---|
| ONR | 88.6 RON | |
| ONR at 0 hrs | | 90.7 RON |
| ONR at 60 hrs | | 89.9 RON |
| ORR | | +0.8 |

From ORR test data, the poly(oxyalkylene)amide-amine gasoline additives show good performance of octane requirement reduction.

What is claimed is:

1. A poly(oxyalkylene)amide-amine compound containing tertiary amine, amide and poly(oxyalkylene) backbone of the following formula:

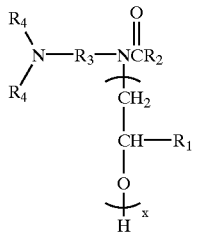

wherein $R_1$ is to 12 carbon atoms; $R_2$ is methyl, ethyl, propyl, or butyl; $R_3$ is the group consisting of alkylene of 1 to 6 carbon atoms; $R_4$ is alkyl of 1 to 4 carbon atoms, and x is from 5 to 30.

2. A process of making a poly(oxyalkylene)amide-amine compound of claim 1 comprising the following reaction:

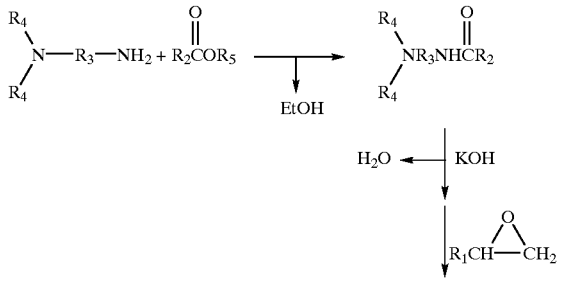

-continued

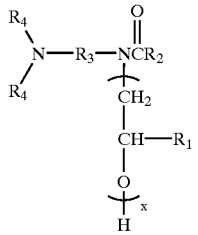

wherein $R_1$ is alkyl of 1 to 12 carbon atoms; $R_2$ is methyl, ethyl, propyl, or butyl; $R_3$ is the group consisting of alkylene of 1 to 6 carbon atoms; $R_4$ is alkyl of 1 to 4 carbon atoms, and x is 5 to 30.

3. A gasoline composition comprising a mixture of:

(a) a major amount of hydrocarbons in the gasoline boiling range;

(b) a minor amount of a poly(oxyalkylene)amide-amine compound having the formula:

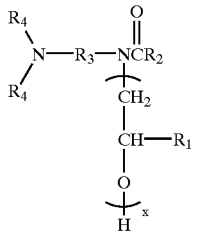

wherein, $R_1$ is alkyl of 1 to 12 carbon atoms; $R_2$ is methyl, ethyl, propyl or butyl; $R_3$ is the group consisting of alkylene of 1 to 6 carbon atoms; R4 is alkyl of 1 to 4 carbon atoms, and x is from 5 to 30; and (c) a minor amount of a detergent selected from the group consisting of polyalkenyl amines, mannich amines, alkyl succinimides, poly(oxyalkylene)carbamates, poly (alkenyl)-N-substituted carbamates and mixtures thereof.

4. The gasoline composition of claim 3, wherein poly (oxyalkylene)amide-amine is present in an amount from about 50 ppm by weight to about 500 ppm by weight of the fuel composition.

5. The gasoline composition of claim 3, wherein the weight average molecular weight of the poly(oxyalkylene) amide-amine is from about 600 to 4000.

* * * * *